US010797422B2

(12) United States Patent
Obata et al.

(10) Patent No.: US 10,797,422 B2
(45) Date of Patent: Oct. 6, 2020

(54) CONNECTOR

(71) Applicant: Japan Aviation Electronics Industry, Limited, Tokyo (JP)

(72) Inventors: Yusuke Obata, Tokyo (JP); Hiroaki Obikane, Tokyo (JP); Masakazu Kuroiwa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/577,186

(22) Filed: Sep. 20, 2019

(65) Prior Publication Data

US 2020/0112118 A1 Apr. 9, 2020

(30) Foreign Application Priority Data

Oct. 9, 2018 (JP) ..... 2018-191050

(51) Int. Cl.
*H01R 13/24* (2006.01)
*H01R 13/17* (2006.01)

(52) U.S. Cl.
CPC ..... *H01R 13/2407* (2013.01); *H01R 13/17* (2013.01); *H01R 13/2492* (2013.01)

(58) Field of Classification Search
CPC ..... H01R 13/2407
USPC ..... 439/636, 637, 862, 74
See application file for complete search history.

(56) References Cited

U.S. PATENT DOCUMENTS 3,120,988 A * 2/1964 Gilbart ..... H01R 12/721 439/747
5,192,232 A * 3/1993 Lenz ..... H01R 12/52 439/660
5,626,500 A * 5/1997 Yoshimura ..... H01R 13/05 439/862
5,641,290 A * 6/1997 Yagi ..... H01R 12/716 439/74

(Continued)

FOREIGN PATENT DOCUMENTS

JP H10-106667 A 4/1998
JP 2009-037970 A 2/2009

(Continued)

OTHER PUBLICATIONS

Extended European Search Report dated Feb. 26, 2020 in European Application No. 19200686.4.

*Primary Examiner* — Neil Abrams
(74) *Attorney, Agent, or Firm* — Collard & Roe, P.C.

(57) ABSTRACT

A connector comprises a housing and a plurality of terminals. The housing has a receiving portion and terminal accommodation portions. Each of the terminals has a fixed portion, a held portion, a first spring portion and a second spring portion. The first spring portion has a first turn portion and a first coupling portion. The second spring portion has a second turn portion, a second coupling portion, an upper contact point and a recessed portion. The upper contact point is positioned in the receiving portion. The upper contact point faces in a first predetermined orientation. The second turn portion has a lower contact point. The lower contact point is positioned in the receiving portion. The lower contact point faces in the first predetermined orientation. The recessed portion is positioned between the upper contact point and the lower contact point in an up-down direction.

5 Claims, 10 Drawing Sheets

(56) References Cited

U.S. PATENT DOCUMENTS

| | | | | |
|---|---|---|---|---|
| 5,836,773 | A * | 11/1998 | McHugh | H01R 12/716 439/74 |
| 6,036,504 | A * | 3/2000 | McHugh | H01R 12/52 439/660 |
| 6,071,129 | A * | 6/2000 | Konno | H01R 12/716 439/74 |
| 7,214,073 | B2 * | 5/2007 | Asai | H01R 13/6594 439/74 |
| 9,054,441 | B2 | 6/2015 | Kimura et al. | |
| 9,252,517 | B2 | 2/2016 | Kimura | |
| 2015/0050842 | A1 | 2/2015 | Miki et al. | |
| 2020/0112118 | A1 * | 4/2020 | Obata | H01R 13/2407 |

FOREIGN PATENT DOCUMENTS

| | | | |
|---|---|---|---|
| JP | 2009-181858 | A | 8/2009 |
| JP | 2014-099391 | A | 5/2014 |
| JP | 6084133 | B2 | 2/2017 |
| JP | 6227225 | B2 | 11/2017 |

* cited by examiner

CONNECTOR

CROSS REFERENCE TO RELATED APPLICATIONS

This application is based on and claims priority under 35 U.S.C. § 119 to Japanese Patent Application No. JP2018-191050 filed Oct. 9, 2018, the contents of which are incorporated herein in their entireties by reference.

BACKGROUND OF THE INVENTION

This invention relates to a connector mateable with a mating connector.

Referring to FIGS. 18 and 19, JP-A 2009-37970 (Patent Document 1) discloses a connector 900 mateable with a mating connector 950 along a Z-direction. The mating connector 950 comprises a mating housing 960 and a plurality of mating terminals 970. The mating terminals 970 are held by the mating housing 960. The connector 900 is mounted on an object 980 when used. The connector 900 comprises a housing 910 and a plurality of terminals 920. The housing 910 has a receiving portion 912 and terminal accommodation portions 916. The receiving portion 912 receives a part of the mating housing 960 when the connector 900 is mated with the mating connector 950. Each of the terminal accommodation portions 916 communicates with the receiving portion 912. The terminal accommodation portions 916 partially accommodate the terminals 920, respectively. The terminals 920 are held by the housing 910 so as to be arranged in two rows in a Y-direction. Specifically, the terminals 920 form a terminal row, which is positioned at a positive X-side of the connector 900, and another terminal row positioned at a negative X-side of the connector 900. Hereinafter, explanation will be made about the terminal 920 included in the terminal row which is positioned at the positive X-side of the connector 900. The terminal 920 has a fixed portion 922, a held portion 924, a first spring portion 930 and a second spring portion 940. The held portion 922 is fixed on the object 980 when the connector 900 is used. The held portion 924 is held by the housing 910. The first spring portion 930 extends from the held portion 924. The first spring portion 930 has a first turn portion 932 and a first coupling portion 936. The first turn portion 932 extends in a positive Z-direction and in a negative X-direction from the held portion 924 and then extends in a negative Z-direction. The first coupling portion 936 extends in the negative Z-direction and in a positive X-direction from the first turn portion 932. The second spring portion 940 extends from the first spring portion 930. The second spring portion 940 has a second turn portion 942, a second coupling portion 944, an upper contact point 946 and a recessed portion 948. The second turn portion 942 is coupled with the first turn portion 932 by the first coupling portion 936. The second turn portion 942 is positioned beyond the first turn portion 932 in the negative Z-direction of the Z-direction. The second coupling portion 944 extends in the positive Z-direction from the second turn portion 942. The upper contact point 946 is coupled with the second turn portion 942 by the second coupling portion 944. The upper contact point 946 faces in the negative X-direction. The upper contact point 946 is positioned in the terminal accommodation portion 916 under a state where the connector 900 and the mating connector 950 are not mated with each other. The second turn portion 942 has a lower contact point 943. The lower contact point 943 is positioned in the receiving portion 912 and faces in the negative X-direction. The recessed portion 948 is recessed in the positive X-direction. The recessed portion 948 is positioned between the upper contact point 946 and the lower contact point 943 in the Z-direction.

When the connector 900 and the mating connector 950 of Patent Document 1 are mated with each other, the mating terminal 970 of the mating connector 950 is brought into contact with the lower contact point 943. Then, the second coupling portion 944 is moved in a seesaw manner so that the upper contact point 946 is moved in the negative X-direction, and thereby the upper contact point 946 is brought into contact with the mating terminal 970.

If the connector 900 of Patent Document 1 is downsized, the terminal 920 has a reduced dimension in the Z-direction. Hence, a travel distance of the upper contact point 946 in the negative X-direction might be reduced upon the mating of the downsized connector 900 with the mating connector 950. Specifically, when the downsized connector 900 is mated with the mating connector 950, only the lower contact point 943 might be brought into contact with the mating terminal 970. In other words, if the connector 900 is downsized, contact reliability between the terminal 920 and the mating terminal 970 might be reduced upon the mating of the downsized connector 900 with the mating connector 950.

SUMMARY OF THE INVENTION

It is therefore an object of the present invention to provide a connector which, if the connector is downsized, can ensure reliable contact between a terminal and a mating terminal upon a mating of the downsized connector with a mating connector.

One aspect of the present invention provides a connector mateable with a mating connector along an up-down direction. The mating connector has a mating housing and a plurality of mating terminals. The mating terminals are held by the mating housing. The connector is mounted on an object when used. The connector comprises a housing and a plurality of terminals. The housing has a receiving portion and terminal accommodation portions. The receiving portion receives a part of the mating housing when the connector is mated with the mating connector. Each of the terminal accommodation portions communicates with the receiving portion. The terminal accommodation portions partially accommodate the terminals, respectively. The terminals are held by the housing. Each of the terminals has a fixed portion, a held portion, a first spring portion and a second spring portion. The fixed portion is fixed on the object when the connector is used. The held portion is held by the housing. The first spring portion extends from the held portion. The first spring portion has a first turn portion and a first coupling portion. The first turn portion extends at least upward or in a first predetermined orientation from the held portion and then extends downward. The first predetermined orientation is along a predetermined direction perpendicular to the up-down direction. The first coupling portion extends downward from the first turn portion. The second spring portion extends from the first spring portion. The second spring portion has a second turn portion, a second coupling portion, an upper contact point and a recessed portion. The second turn portion is coupled with the first turn portion by the first coupling portion. The second turn portion is positioned below the first turn portion in the up-down direction. The second coupling portion extends upward from the second turn portion. The upper contact point is coupled with the second turn portion by the second coupling portion. The upper contact point is positioned in the receiving portion. The upper contact point faces in the first predetermined orientation. The second turn portion has a lower contact point. The lower contact point is positioned in the receiving portion. The lower contact point faces in the first predetermined orientation. In the predetermined direction, the recessed portion is recessed in a second predetermined orientation opposite to the first predetermined orientation. The recessed portion is positioned between the upper contact point and the lower contact point in the up-down direction.

In the connector of the present invention, both of the upper contact point and the lower contact point are positioned in the receiving portion of the housing. Accordingly, the connector of the present invention has a configuration where both of the upper contact point and the lower contact point make sure contact with the mating terminal upon the mating of a downsized connector with the mating connector even if the connector is downsized. In other words, even if the connector of the present invention is downsized, the connector of the present invention can ensure reliable contact between the terminal and the mating terminal upon the mating of the downsized connector with the mating connector.

An appreciation of the objectives of the present invention and a more complete understanding of its structure may be had by studying the following description of the preferred embodiment and by referring to the accompanying drawings.

Figure 1:
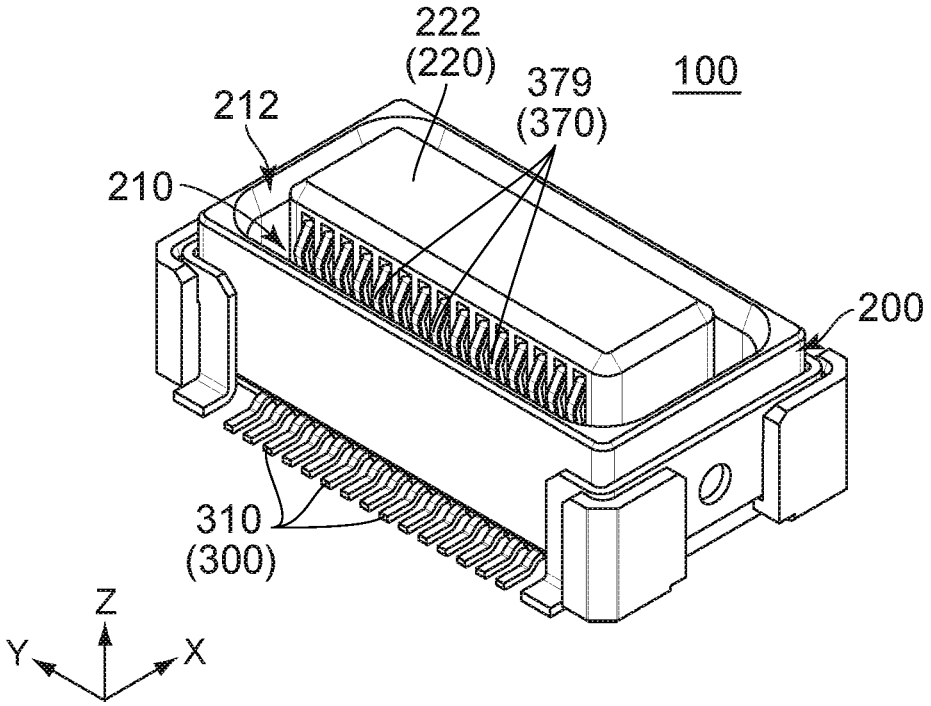
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 11:
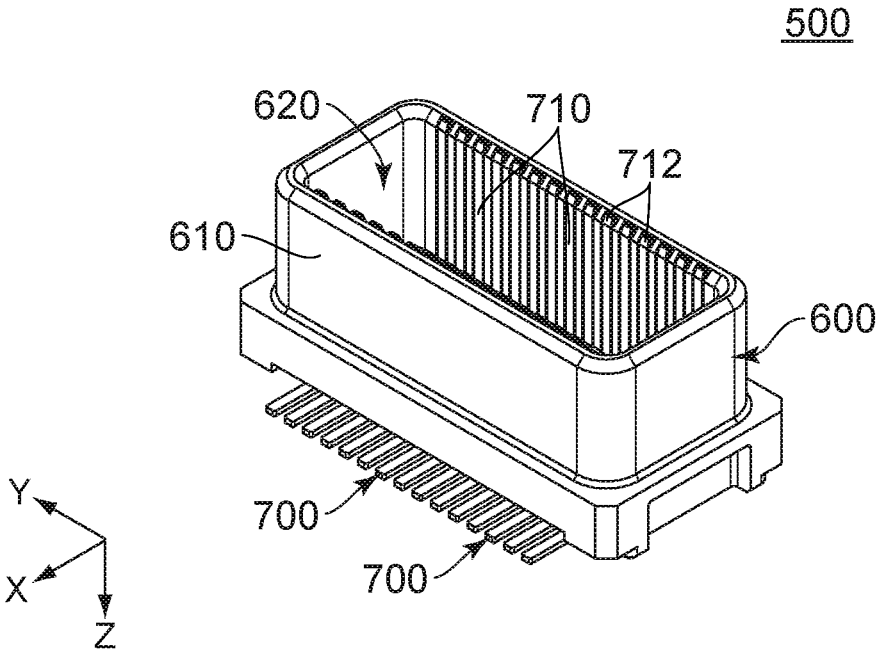
FIG. 11 is a perspective view showing a mating connector which is mateable with the connector of FIG. 1.
Figure 12:
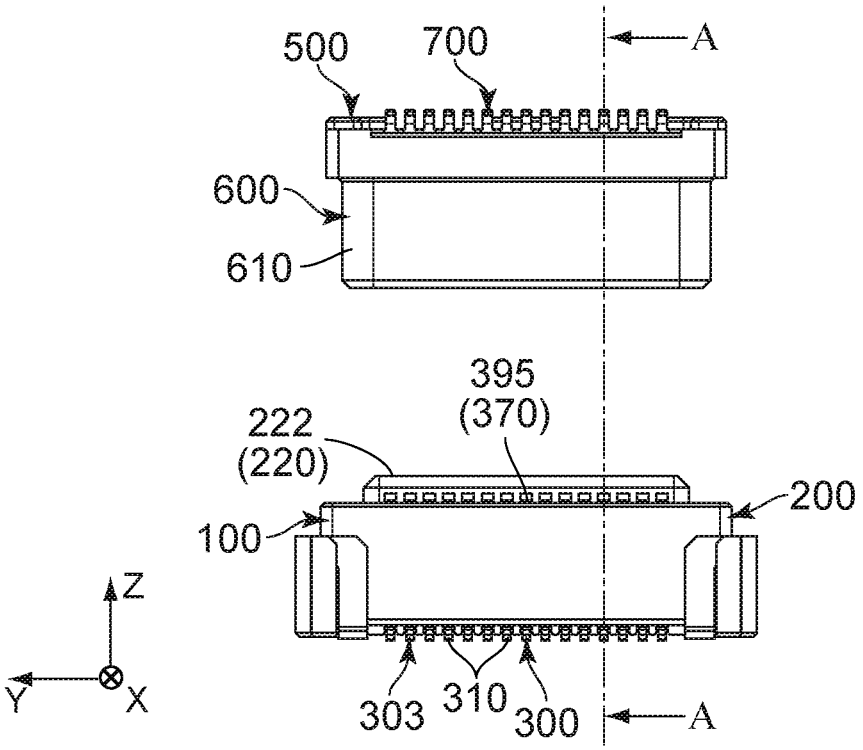
FIG. 12 is a side view showing the connector of FIG. 1 and the mating connector of FIG. 11. In the figure, the connector and the mating connector are not mated with each other.
Figure 17:
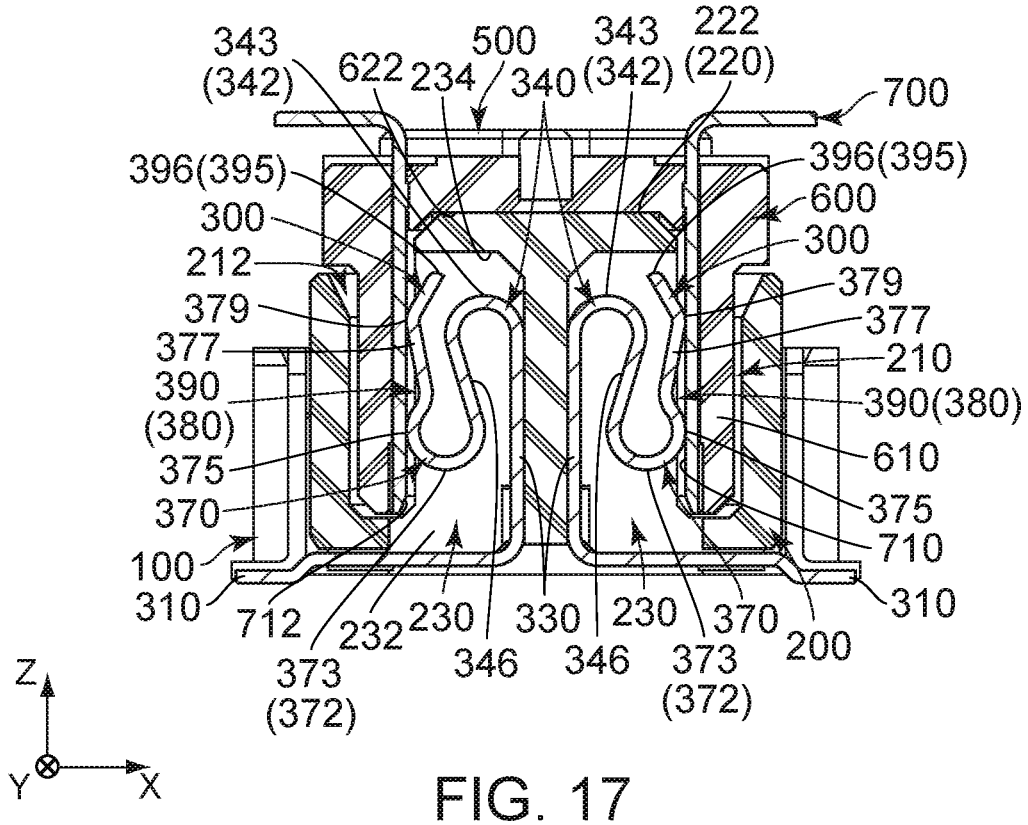
FIG. 17 is a cross-sectional view showing the connector and the mating connector of FIG. 16, taken along line C-C. In the figure, both of the upper contact point and the lower contact point of the terminal of the connector are in contact with the mating terminal of the mating connector.
Figure 18:
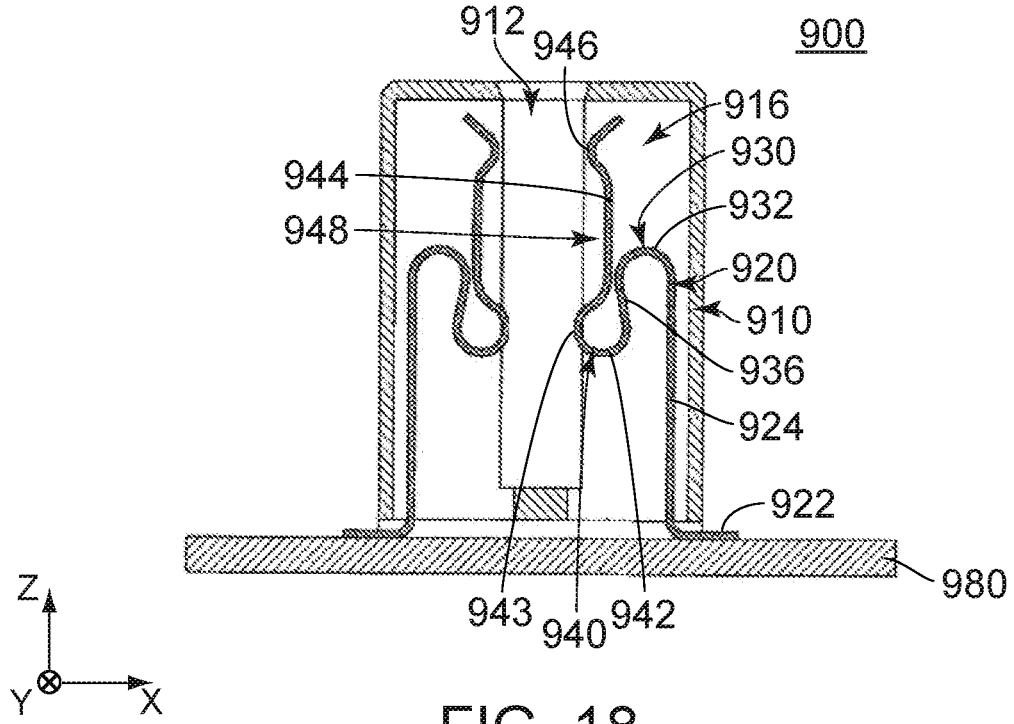
FIG. 18 PRIOR ART
FIG. 18 is a cross-sectional view showing a connector of Patent Document 1.
Figure 19:
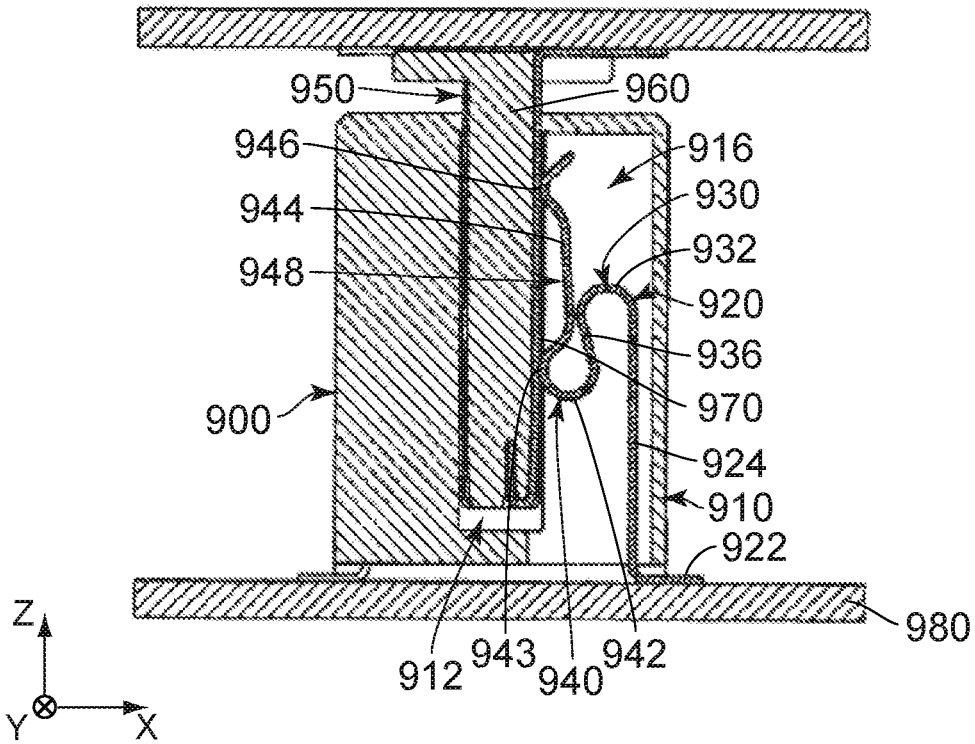
FIG. 19 PRIOR ART
FIG. 19 is a cross-sectional view showing the connector and a mating connector of Patent Document 1. In the figure, the connector and the mating connector are in a mated state.

Referring to FIGS. 1, 11 and 17, a connector 100 according to an embodiment of the present invention is mateable with a mating connector 500 along an up-down direction. In the present embodiment, the up-down direction is a Z-direction. Specifically, it is assumed that upward is a positive Z-direction while downward is a negative Z-direction.

As shown in FIG. 11, the mating connector 500 of the present embodiment comprises a mating housing 600 and a plurality of mating terminals 700.

As shown in FIG. 11, the mating housing 600 of the present embodiment has a surrounding portion 610 and an island-like portion accommodation portion 620.

As shown in FIG. 11, the surrounding portion 610 of the present embodiment has a substantially rectangular tube shape extending in the up-down direction.

Figure 13:
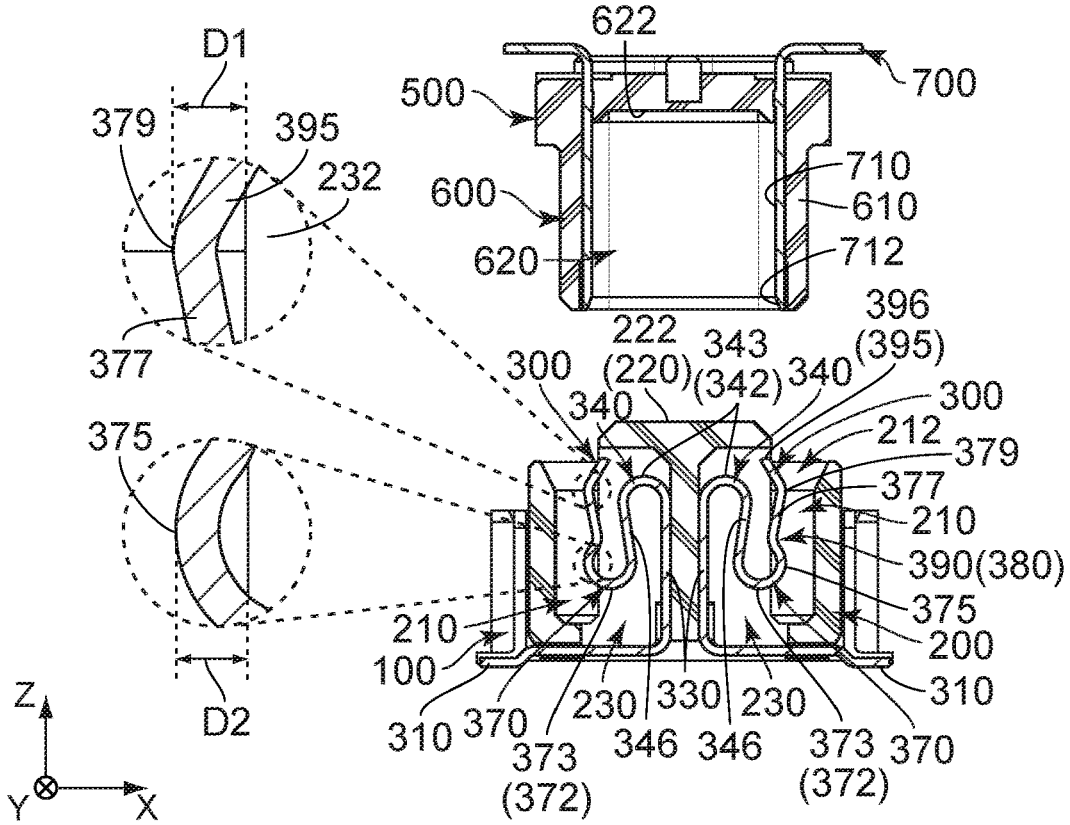
FIG. 13 is a cross-sectional view showing the connector and the mating connector of FIG. 12, taken along line A-A. In the figure, parts of a second spring portion are illustrated enlarged.
Figure 14:
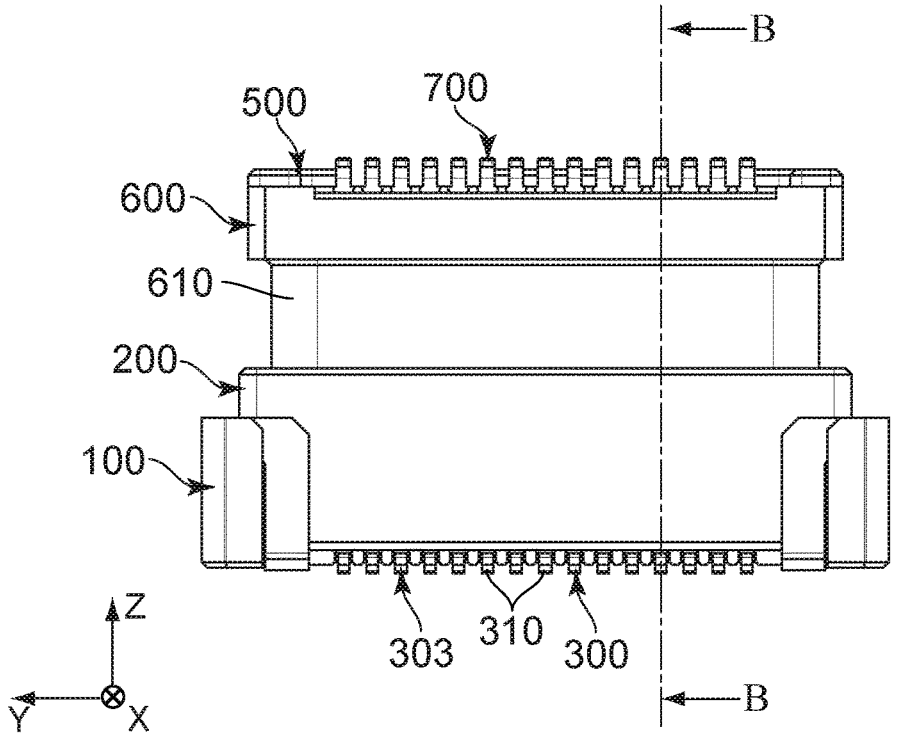
FIG. 14 is another side view showing the connector of FIG. 1 and the mating connector of FIG. 11. In the figure, the connector and the mating connector are in the middle of the mating process.

As shown in FIG. 11, the island-like portion accommodation portion 620 of the present embodiment is surrounded by the surrounding portion 610 in a plane perpendicular to the up-down direction. As shown in FIG. 13, the island-like portion accommodation portion 620 is a recess which is recessed upward in the up-down direction. The island-like portion accommodation portion 620 has an upper surface 622. The upper surface 622 defines an upper end of the island-like portion accommodation portion 620 in the up-down direction.

As shown in FIG. 11, the mating terminals 700 of the present embodiment are held by the mating housing 600. Each of the mating terminals 700 has a mating contact portion 710. The mating contact portion 710 is exposed in the island-like portion accommodation portion 620. The mating contact portion 710 faces inward in a predetermined direction. The mating contact portion 710 has a slope surface 712 at its lower end. The slope surface 712 is sloped downward in the up-down direction and outward in the predetermined direction. In the present embodiment, the predetermined direction is an X-direction.

Figure 4:
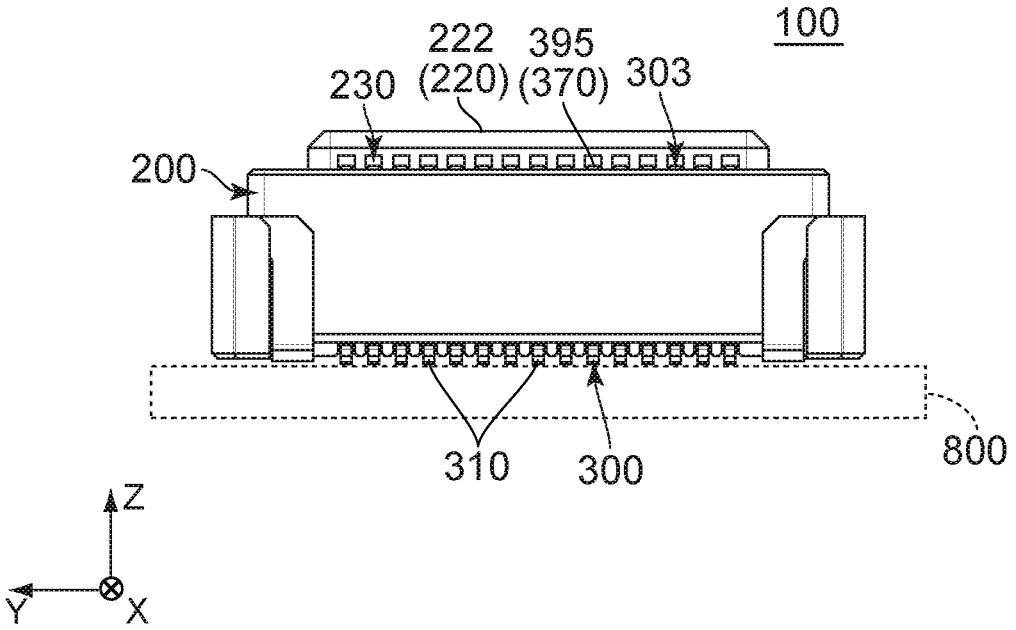
FIG. 4 is a side view showing the connector of FIG. 1. In the figure, an object is illustrated by dotted line.

As shown in FIG. 4, the connector 100 of the present embodiment is mounted on an object 800 when used.

As shown in FIG. 1, the connector 100 of the present embodiment comprises a housing 200 and a plurality of terminals 300.

As shown in FIG. 1, the housing 200 of the present embodiment has a receiving portion 210 and an island-like portion 220.

As shown in FIGS. 1, 13, 15 and 17, the receiving portion 210 of the present embodiment is opened upward in the up-down direction. Specifically, the receiving portion 210 is a recess which is recessed downward in the up-down direction. The receiving portion 210 has an opening 212 at its upper end. The receiving portion 210 of the present embodiment receives a part of the mating housing 600 when the connector 100 is mated with the mating connector 500.

As shown in FIGS. 1 and 13, the island-like portion 220 of the present embodiment protrudes upward in the up-down direction. The island-like portion 220 has an upper end 222 in the up-down direction. The island-like portion 220 is surrounded by the receiving portion 210 in a direction perpendicular to the up-down direction. The upper end 222 of the island-like portion 220 is positioned above the opening 212 of the receiving portion 210 in the up-down direction. The island-like portion 220 has a plurality of terminal accommodation portions 230. In other words, the housing 200 has the receiving portion 210 and the terminal accommodation portions 230.

Figure 2:
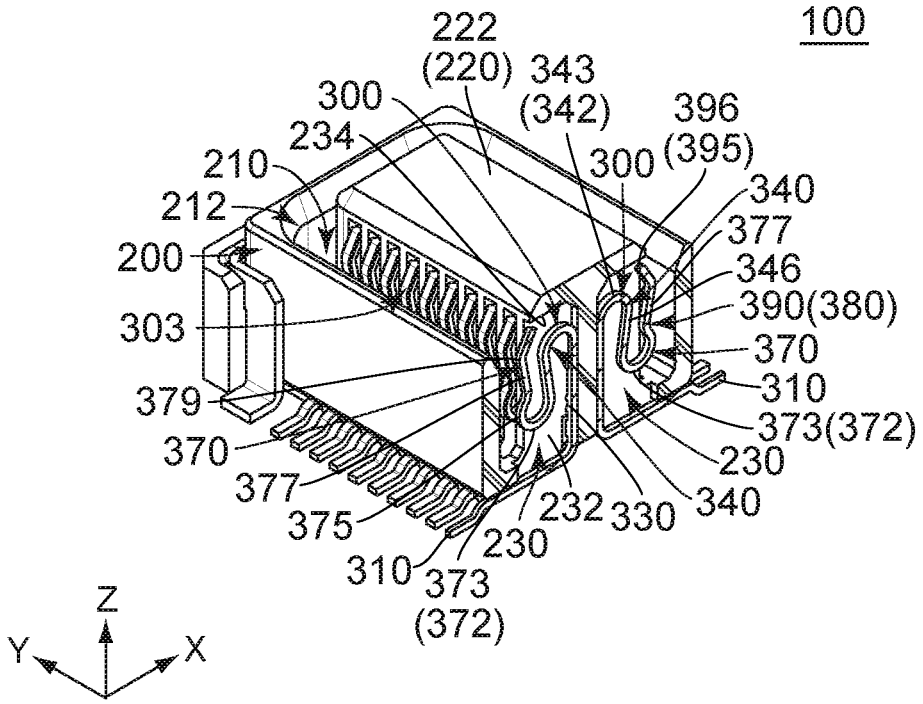
FIG. 2 is a partially cut-away, perspective view showing the connector of FIG. 1.

As shown in FIG. 13, each of the terminal accommodation portions 230 of the present embodiment communicates with the receiving portion 210. The terminal accommodation portions 230 partially accommodate the terminals 300, respectively. Each of the terminal accommodation portions 230 communicates with the receiving portion 210 in the predetermined direction. Referring to FIG. 2, each of the terminal accommodation portions 230 has two side walls 232 and an upper wall 234.

Specifically, each of the side walls 232 is perpendicular to a pitch direction, while the upper wall 234 is perpendicular to the up-down direction. The side walls 232 are positioned at opposite ends, respectively, of the terminal accommodation portion 230 in the pitch direction. The upper wall 234 defines an upper end of the terminal accommodation portion 230 in the up-down direction. In the present embodiment, the pitch direction is a Y-direction.

Figure 3:
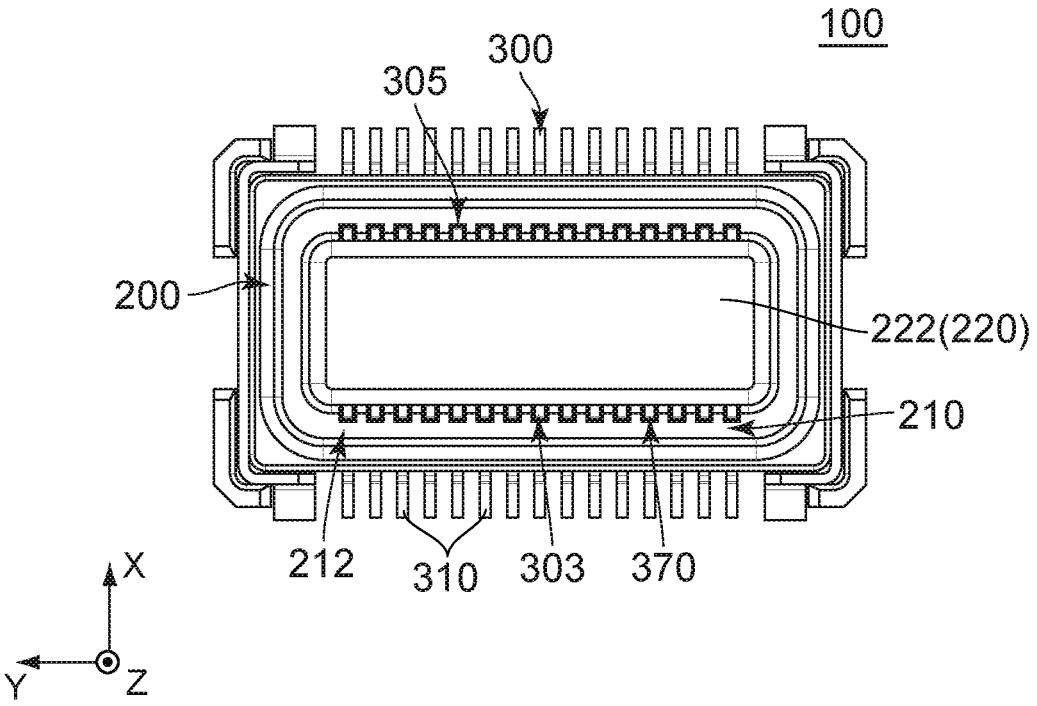
FIG. 3 is a top view showing the connector of FIG. 1.

As shown in FIGS. 2 and 13, the terminals 300 of the present embodiment are held by the housing 200. Referring to FIG. 3, the terminals 300 are arranged in two rows in the pitch direction. Specifically, the terminals 300 form two terminal rows 303, 305 which are arranged in the predetermined direction. The terminal row 303 is positioned beyond the terminal row 305 in a negative X-direction of the predetermined direction.

Hereinafter, explanation will be made about the terminal 300 included in the terminal row 303 as shown in FIG. 3. The terminal 300, which is included in the terminal row 305 as shown in FIG. 3, has a structure same as that of the terminal 300, which is included in the terminal row 303, other than definitions of a first predetermined orientation and a second predetermined orientation as described below. Accordingly, detailed explanation thereabout is omitted.

Referring to FIGS. 5 to 10, the terminal 300 of the present embodiment is a so-called bent contact, which is formed by bending a metal blank. However, the present invention is not limited thereto. The terminal 300 may be a so-called punched contact, which is formed by punching out a metal plate.

Figure 6:
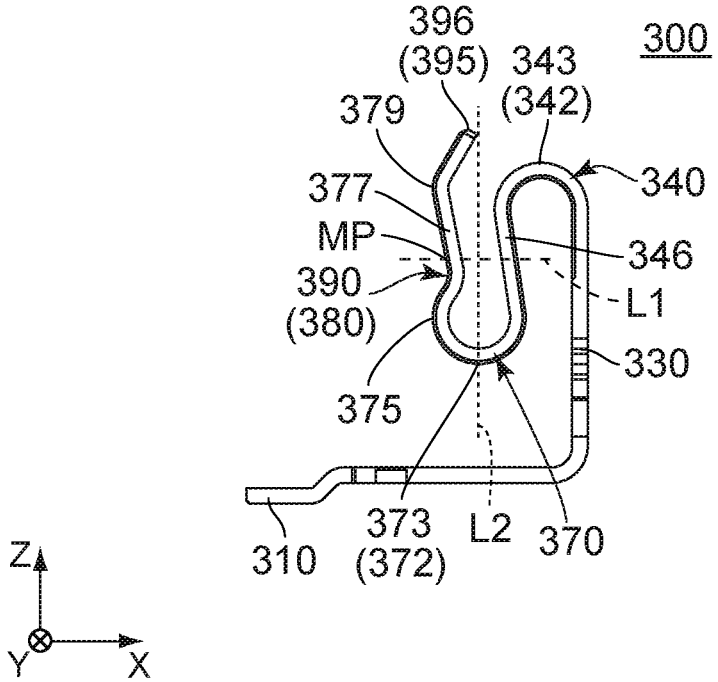
FIG. 6 is a side view showing the terminal of FIG. 5.

As shown in FIG. 6, the terminal 300 of the present embodiment has a fixed portion 310, a held portion 330, a first spring portion 340 and a second spring portion 370.

As shown in FIG. 4, the fixed portion 310 of the present embodiment is fixed to the object 800 when the connector 100 is used. As shown in FIG. 6, the fixed portion 310 defines a lower end of the terminal 300 in the up-down direction. The fixed portion 310 defines an outer end of the terminal 300 in the predetermined direction. Specifically, the fixed portion 310 defines an end of the terminal 300 in the negative X-direction of the predetermined direction. Regarding the terminal 300 of the terminal row 303, it is assumed that a first predetermined orientation is the negative X-direction while a second predetermined orientation is a positive X-direction. Regarding the terminal 300 of the terminal row 305 as shown in FIG. 3, it is assumed that a first predetermined orientation is the positive X-direction while a second predetermined orientation is the negative X-direction.

Figure 8:
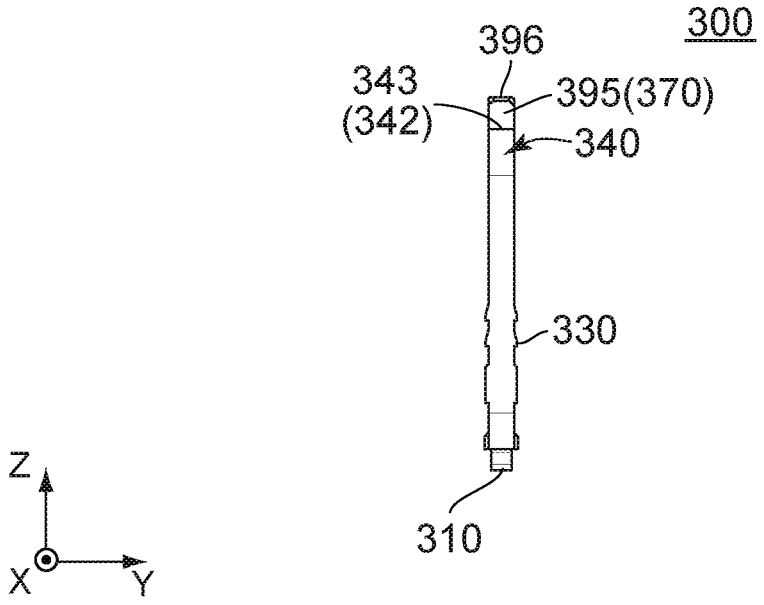
FIG. 8 is a rear view showing the terminal of FIG. 5.
Figure 9:
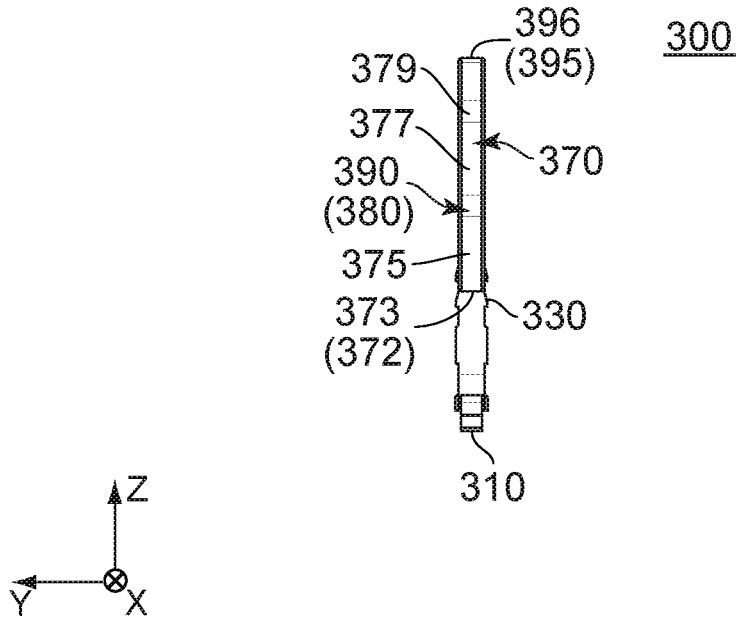
FIG. 9 is a front view showing the terminal of FIG. 5.

As shown in FIG. 8, the held portion 330 of the present embodiment protrudes outward in the pitch direction. As shown in FIG. 6, the held portion 330 is positioned above the fixed portion 310 in the up-down direction. As shown in FIG. 2, the held portion 330 of the present embodiment is held by the housing 200. Specifically, the held portion 330 is press-fit into the housing 200. In detail, the held portion 330 is press-fit into the side wall 232 of the terminal accommodation portion 230 of the housing 200. However, the present invention is not limited thereto. The held portion 330 may be embedded in the housing 200 via insert-molding.

Figure 5:
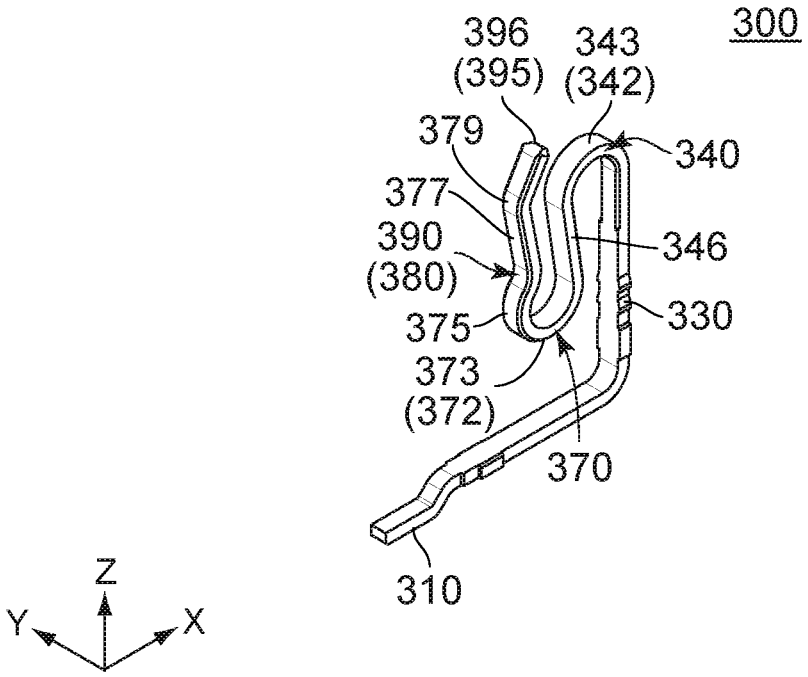
FIG. 5 is a front, perspective view showing a terminal which is included in the connector of FIG. 1.
Figure 7:
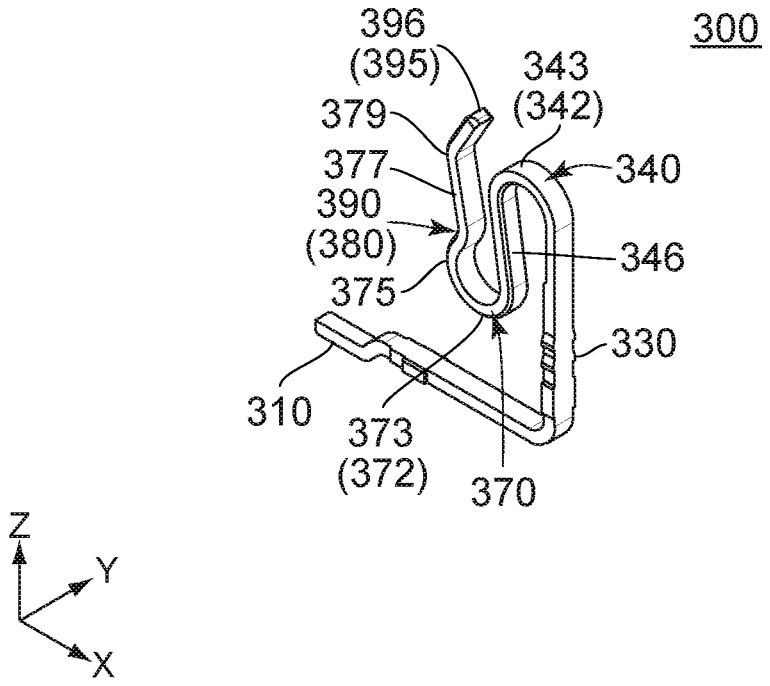
FIG. 7 is a rear, perspective view showing the terminal of FIG. 5.

As shown in FIGS. 5 to 7, the first spring portion 340 of the present embodiment extends from the held portion 330. The first spring portion 340 has a substantially U-shape when viewed along the pitch direction.

As shown in FIGS. 5 to 7, the first spring portion 340 of the present embodiment has a first turn portion 342 and a first coupling portion 346.

As shown in FIGS. 5 to 7, the first turn portion 342 of the present embodiment extends upward and in the first predetermined orientation from the held portion 330 and then extends downward. Specifically, a direction, in which the first spring portion 340 extends, is changed at the first turn portion 342. However, the present invention is not limited thereto. The first spring portion 340 may be configured so that the first turn portion 342 extends in the first predetermined orientation from the held portion 330 and then extends downward. In other words, the shape of the first turn portion 342 may be modified, provided that the first turn portion 342 extends downwards after the first turn portion 342 extends upward or extends in the first predetermined orientation from the held portion 330, wherein the first predetermined orientation is along the predetermined direction perpendicular to the up-down direction. The first turn portion 342 has an upper end 343 in the up-down direction. The first turn portion 342 is positioned above the held portion 330 in the up-down direction. In other words, the held portion 330 is positioned below the first turn portion 342 in the up-down direction.

As shown in FIGS. 5 to 7, the first coupling portion 346 of the present embodiment extends downward from the first turn portion 342. More specifically, the first coupling portion 346 extends downward and in the second predetermined orientation from the first turn portion 342. The first coupling portion 346 has an elongated plate-like shape.

As shown in FIGS. 5 to 7, the second spring portion 370 of the present embodiment extends from the first spring portion 340.

As shown in FIGS. 5 to 7, the second spring portion 370 of the present embodiment has a second turn portion 372, a second coupling portion 377, an upper contact point 379, a recessed portion 390 and a guide portion 395.

Figure 10:
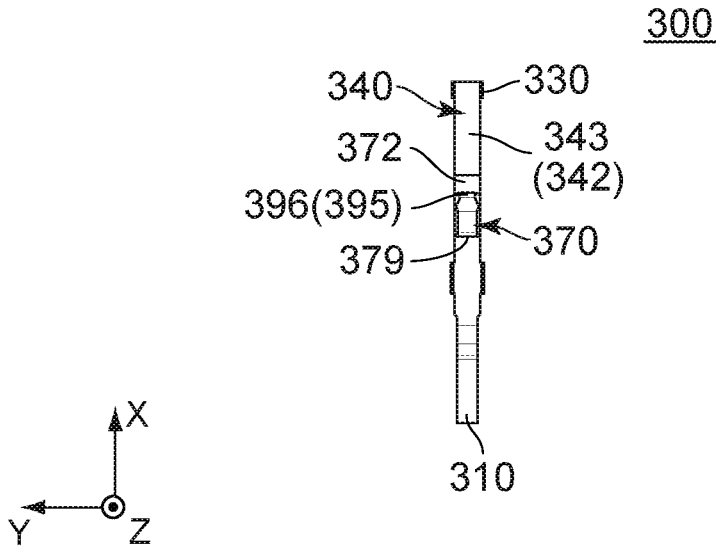
FIG. 10 is a top view showing the terminal of FIG. 5.

As shown in FIGS. 5 to 7, the second turn portion 372 of the present embodiment has a substantially C-shape when viewed along the pitch direction. Specifically, a direction, in which the second spring portion 370 extends, is changed at the second turn portion 372. The second turn portion 372 has a lower end 373 in the up-down direction. The second turn portion 372 is coupled with the first turn portion 342 by the first coupling portion 346. The second turn portion 372 is positioned below the first turn portion 342 in the up-down direction. As shown in FIG. 10, a part of the second turn portion 372 is visible when the terminal 300 is independently viewed from above.

As shown in FIG. 6, the first turn portion 342 is positioned above an imaginary line L1 in the up-down direction, wherein the imaginary line L1 is parallel to the predetermined direction while passing through a midpoint MP between the upper end 343 of the first turn portion 342 and the lower end 373 of the second turn portion 372 in the up-down direction. The first coupling portion 346 overlaps with the imaginary line L1. The first coupling portion 346 is positioned in the second predetermined orientation beyond an imaginary line L2 which is parallel to the up-down direction while passing through the lower end 373 of the second turn portion 372. The first coupling portion 346 does not overlap with the imaginary line L2. The second turn portion 372 is positioned below the imaginary line L1 in the up-down direction.

As shown in FIGS. 5 to 7, the second coupling portion 377 of the present embodiment has an elongated plate-like shape. The second coupling portion 377 overlaps with the imaginary line L1. The second coupling portion 377 is positioned beyond the imaginary line L2 in the first predetermined orientation. The second coupling portion 377 does not overlap with the imaginary line L2. The second coupling portion 377 extends upward from the second turn portion 372. More specifically, the second coupling portion 377 linearly extends from the recessed portion 390 to the upper contact point 379. However, the present invention is not limited thereto. The second spring portion 370 may be configured so that the second coupling portion 377 extends from the recessed portion 390 to the upper contact point 379 while being arched in the first predetermined orientation. In other words, the second coupling portion 377 may have an arc shape which is arched in the first predetermined orientation.

As shown in FIGS. 5 to 7, the upper contact point 379 of the present embodiment is brought into contact with the mating contact portion 710 of the mating terminal 700 when the connector 100 and the mating connector 500 are mated with each other. The upper contact point 379 is coupled with the second turn portion 372 by the second coupling portion 377. The upper contact point 379 is positioned above the imaginary line L1 in the up-down direction. The upper contact point 379 is positioned beyond the imaginary line L2 in the first predetermined orientation.

As shown in FIG. 13, the upper contact point 379 of the present embodiment is positioned in the receiving portion 210. The upper contact point 379 faces in the first predetermined orientation. The upper contact point 379 is positioned apart from the terminal accommodation portion 230 by a distance D1 in the predetermined direction. More specifically, in the predetermined direction, the upper contact point 379 is positioned apart from an end of the side wall 232 of the terminal accommodation portion 230 in the first predetermined orientation by the distance D1. As shown in FIG. 6, in the up-down direction, the upper contact point 379 is positioned above the midpoint MP between the upper end 343 of the first turn portion 342 and the lower end 373 of the second turn portion 372. The upper contact point 379 is positioned below the upper end 343 of the first turn portion 342 in the up-down direction. The upper contact point 379 is positioned above the first coupling portion 346 in the up-down direction.

As shown in FIGS. 5 to 7, the second turn portion 372 of the present embodiment has a lower contact point 375.

As shown in FIG. 6, the lower contact point 375 of the present embodiment is brought into contact with the mating contact portion 710 of the mating terminal 700 when the connector 100 and the mating connector 500 are mated with each other. The lower contact point 375 is positioned below the midpoint MP in the up-down direction. The lower contact point 375 is positioned above the lower end 373 of the second turn portion 372 in the up-down direction.

As shown in FIG. 13, the lower contact point 375 of the present embodiment is positioned in the receiving portion 210. The lower contact point 375 faces in the first predetermined orientation. The lower contact point 375 is positioned apart from the terminal accommodation portion 230 by a distance D2 in the predetermined direction. More specifically, in the predetermined direction, the lower contact point 375 is positioned apart from the end of the side wall 232 of the terminal accommodation portion 230 in the first predetermined orientation by the distance D2.

Referring to FIG. 13, in the predetermined direction, the distance D1 between the upper contact point 379 and the terminal accommodation portion 230 is greater than the distance D2 between the lower contact point 375 and the terminal accommodation portion 230. More specifically, in the predetermined direction, the distance D1 between the upper contact point 379 and the end of the side wall 232 of the terminal accommodation portion 230 in the first predetermined orientation is greater than the distance D2 between the lower contact point 375 and the end of the side wall 232 of the terminal accommodation portion 230 in the first predetermined orientation. That is, in the receiving portion 210, the upper contact point 379 is positioned inward beyond the lower contact point 375 in the predetermined direction.

As shown in FIG. 6, in the predetermined direction, the recessed portion 390 of the present embodiment is recessed in the second predetermined orientation which is opposite to the first predetermined orientation. The recessed portion 390 is formed on a boundary portion 380 between the second turn portion 372 and the second coupling portion 377. The recessed portion 390 is positioned between the upper contact point 379 and the lower contact point 375 in the up-down direction. The recessed portion 390 is positioned beyond the imaginary line L2 in the first predetermined orientation. The recessed portion 390 does not overlap with the imaginary line L2.

As shown in FIG. 6, the recessed portion 390 is positioned below the midpoint MP between the upper end 343 of the first turn portion 342 and the lower end 373 of the second turn portion 372 in the up-down direction. Accordingly, the upper contact point 379 can have an appropriate movement range in the predetermined direction while the terminal 300 has a reduced size in the up-down direction.

As shown in FIGS. 5 to 7, the guide portion 395 of the present embodiment extends upward in the up-down direction and in the second predetermined orientation from the upper contact point 379. More specifically, the guide portion 395 linearly extends upward in the up-down direction and in the second predetermined orientation from the upper contact point 379. The guide portion 395 has an upper end 396 in the up-down direction. The upper end 396 is a free end. The guide portion 395 has an elongated plate-like shape. The upper end 396 is positioned above the upper end 343 of the first turn portion 342 in the up-down direction. As shown in FIG. 13, the upper end 396 is positioned in the terminal accommodation portion 230 of the housing 200.

A further description will be made below about an operation of mating the connector 100 with the mating connector 500 of the present embodiment and movement statuses of components of the terminal 300 of the connector 100 upon the mating thereof therewith.

Referring to FIG. 13, the connector 100 and the mating connector 500 are first positioned so that the island-like portion 220 of the connector 100 faces the island-like portion accommodation portion 620 of the mating connector 500 in the up-down direction while the receiving portion 210 of the connector 100 faces the surrounding portion 610 of the mating connector 500 in the up-down direction.

If the mating connector 500 is moved downward relative to the connector 100 in succession to the above-mentioned positioning so that the mating connector 500 and the connector 100 approach each other in the up-down direction, the slope surfaces 712 of the mating contact portions 710 of the mating terminals 700 of the mating connector 500 are brought into contact with the guide portions 395 of the terminals 300, respectively, of the connector 100 in the up-down direction.

When the mating connector 500 is pushed downward at that time, the slope surface 712 of the mating contact portion 710 of the mating terminal 700 of the mating connector 500 is moved downward while moving the guide portion 395 of the terminal 300 corresponding thereto of the connector 100 in the second predetermined orientation. Then, the slope surface 712 is brought into contact with the upper contact point 379 of the terminal 300 corresponding thereto.

As described above, the upper contact point 379 is positioned above the midpoint MP between the upper end 343 of the first turn portion 342 and the lower end 373 of the second turn portion 372 in the up-down direction. Accordingly, when the slope surface 712 of the mating contact portion 710 of the mating terminal 700 of the mating connector 500 moves the guide portion 395 of the terminal 300 corresponding thereto of the connector 100 in the second predetermined orientation, the lower contact point 375 is slightly moved in the first predetermined orientation.

Figure 15:
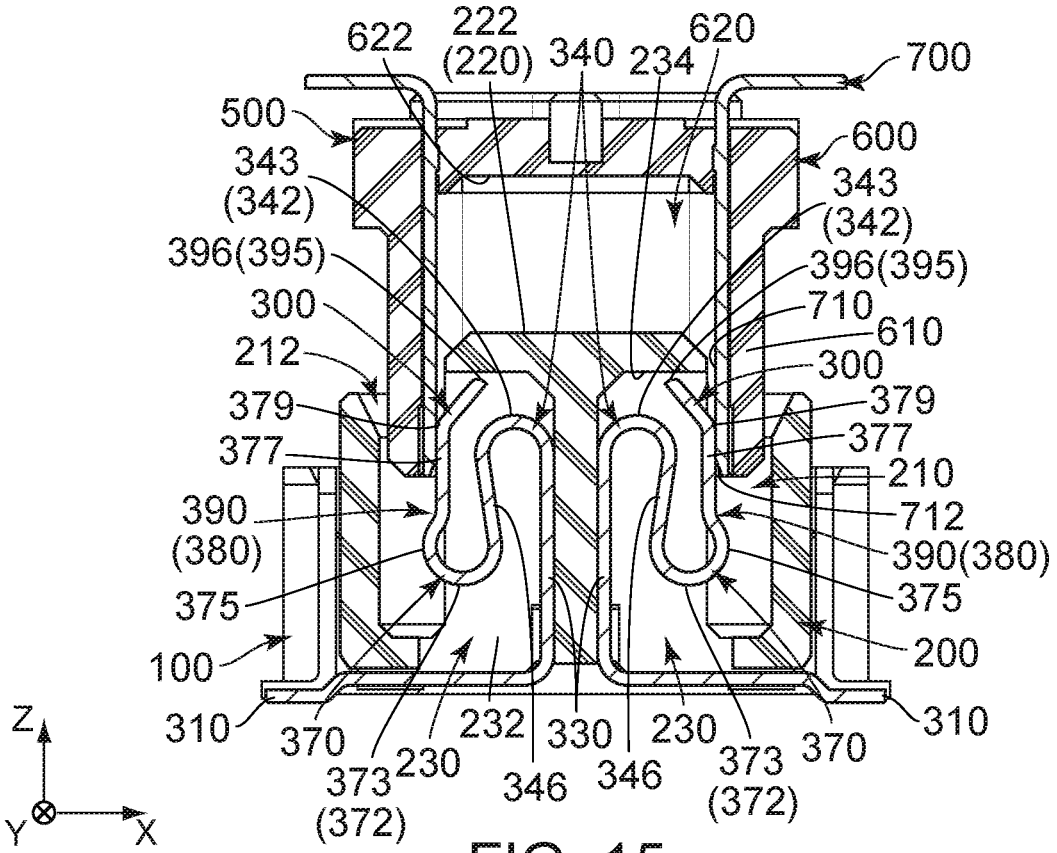
FIG. 15 is a cross-sectional view showing the connector and the mating connector of FIG. 14, taken along line B-B. In the figure, an upper contact point of the terminal of the connector is in contact with a mating terminal of the mating connector while a lower contact point of the terminal of the connector is not contact with the mating terminal of the mating connector.
Figure 16:
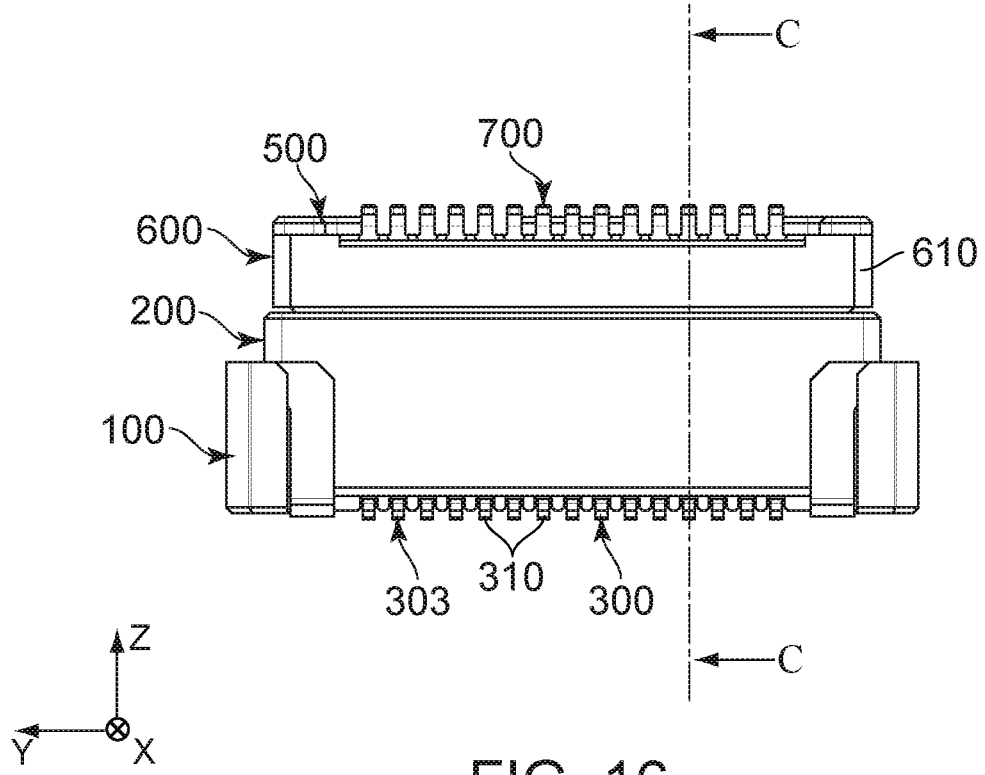
FIG. 16 is yet another side view showing the connector of FIG. 1 and the mating connector of FIG. 11. In the figure, the connector and the mating connector are in a mated state.

When the mating connector 500 is further pushed downward under a state where the slope surface 712 of the mating terminal 700 of the mating connector 500 is in contact with the upper contact point 379 of the terminal 300 corresponding thereto of the connector 100, the connector 100 and the mating connector 500 change their state into a state shown in FIG. 15.

Meanwhile, a part of the surrounding portion 610 of the mating connector 500 is received in the receiving portion 210 of the connector 100 while a part of the island-like portion 220 of the connector 100 is accommodated in the island-like portion accommodation portion 620 of the mating connector 500. Also, the mating contact portion 710 of the mating terminal 700 of the mating connector 500 is in contact with the upper contact point 379 of the terminal 300 corresponding thereto of the connector 100 in the predetermined direction.

When the mating connector 500 is yet further moved downward under the state shown in FIG. 15, the slope surface 712 of the mating contact portion 710 of the mating terminal 700 of the mating connector 500 is moved downward while moving the lower contact point 375 of the terminal 300 corresponding thereto of the connector 100 in the second predetermined orientation. Thus, the connector 100 and the mating connector 500 change their state into a state shown in FIG. 17.

Meanwhile, the mating contact portion 710 of the mating terminal 700 of the mating connector 500 is in contact with both the upper contact point 379 and the lower contact point 375 of the terminal 300 corresponding thereto of the connector 100 in the predetermined direction.

As described above, the lower contact point 375 is slightly moved in the first predetermined orientation of the predetermined direction when the mating terminal 700 of the mating connector 500 is brought into contact with the upper contact point 379 of the terminal 300 corresponding thereto of the connector 100 and results in the state of FIG. 15. Thus, the lower contact point 375 of the terminal 300 of the connector 100 can be brought into contact with the mating terminal 700 corresponding thereto of the mating connector 500 with sufficient contact pressure under the state shown in FIG. 17.

Although the specific explanation about the present invention is made above referring to the embodiments, the present invention is not limited thereto and is susceptible to various modifications and alternative forms.

Although the receiving portion 210 of the connector 100 of the present embodiment is opened upward in the up-down direction and is configured to receive the mating connector 500 from above, the present invention is not limited thereto. The connector 100 may be modified to be opened downward in the up-down direction and to be configured to receive the mating connector 500 from below. In this case, when the modified connector 100 and the mating connector 500 are mated with each other, the upper contact point 379 is brought into contact with the mating contact portion 710 after the lower contact point 375 is brought into contact with the mating contact portion 710.

Although the held portion 330 of the terminal 300 of the connector 100 of the present embodiment is positioned below the first turn portion 342, the present invention is not limited thereto. Specifically, referring to FIG. 6, the arrangement of the held portion 330 may be modified, provided that the held portion 330 is positioned on a part of the terminal 300 which extends from the illustrated original position of the held portion 330 to the illustrated position of the upper end 343 of the first turn portion 342.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along an up-down direction, wherein:

the mating connector has a mating housing and a plurality of mating terminals;

the mating terminals are held by the mating housing;

the connector is mounted on an object when used;

the connector comprises a housing and a plurality of terminals;

the housing has a receiving portion and terminal accommodation portions;

the receiving portion receives a part of the mating housing when the connector is mated with the mating connector;

each of the terminal accommodation portions communicates with the receiving portion;

the terminal accommodation portions partially accommodate the terminals, respectively;

the terminals are held by the housing;

each of the terminals has a fixed portion, a held portion, a first spring portion and a second spring portion;

the fixed portion is fixed on the object when the connector is used;

the held portion is held by the housing;

the first spring portion extends from the held portion;

the first spring portion has a first turn portion and a first coupling portion;

the first turn portion extends at least upward or in a first predetermined orientation from the held portion and then extends downward;

the first predetermined orientation is along a predetermined direction perpendicular to the up-down direction;

the first coupling portion extends downward from the first turn portion;

the second spring portion extends from the first spring portion;

the second spring portion has a second turn portion, a second coupling portion, an upper contact point and a recessed portion;

the second turn portion is coupled with the first turn portion by the first coupling portion;

the second turn portion is positioned below the first turn portion in the up-down direction;

the second coupling portion extends upward from the second turn portion;

the upper contact point is coupled with the second turn portion by the second coupling portion;

the upper contact point is positioned in the receiving portion;

the upper contact point faces in the first predetermined orientation;

the second turn portion has a lower contact point;

the lower contact point is positioned in the receiving portion;

the lower contact point faces in the first predetermined orientation;

in the predetermined direction, the recessed portion is recessed in a second predetermined orientation opposite to the first predetermined orientation;

the recessed portion is positioned between the upper contact point and the lower contact point in the up-down direction; and in the predetermined direction, a distance between the upper contact point and the terminal accommodation portion is greater than a distance between the lower contact point and the terminal accommodation portion.

2. The connector as recited in claim 1, wherein the receiving portion is opened upward in the up-down direction.

3. The connector as recited in claim 1, wherein:

the first turn portion has an upper end in the up-down direction;

the second turn portion has a lower end in the up-down direction; and in the up-down direction, the upper contact point is positioned above a midpoint between the upper end of the first turn portion and the lower end of the second turn portion.

4. The connector as recited in claim 1, wherein:

the recessed portion is formed on a boundary portion between the second turn portion and the second coupling portion;

the first turn portion has an upper end in the up-down direction;

the second turn portion has a lower end in the up-down direction; and in the up-down direction, the recessed portion is positioned below a midpoint between the upper end of the first turn portion and the lower end of the second turn portion.

5. The connector as recited in claim 4, wherein the second coupling portion linearly extends from the recessed portion to the upper contact point.

* * * * *